US005136521A

United States Patent [19]

van Daalen et al.

[11] Patent Number: 5,136,521

[45] Date of Patent: Aug. 4, 1992

[54] PUNCHING MACHINE WITH CONTROLLED PUNCH AND DIE POSITIONING AND CONTROLLED PUNCH OPERATING STROKE

[75] Inventors: Peter van Daalen, Hengelo; Zwaaftink Groot, Borne, both of Netherlands

[73] Assignee: Holding M. Brouwer & Co. B.V., Hengelo, Netherlands

[21] Appl. No.: 578,257

[22] Filed: Sep. 6, 1990

[30] Foreign Application Priority Data

Sep. 12, 1989 [NL] Netherlands ..... 8902274

[51] Int. Cl.[5] ..... G06F 15/46

[52] U.S. Cl. ..... 364/474.02; 364/474.17

[58] Field of Search ..... 72/21; 83/140, 76.8, 83/76.9; 364/474.2, 474.02, 476, 474.16, 474.17; 234/35, 120

[56] References Cited

U.S. PATENT DOCUMENTS

| | | | |
|---|---|---|---|
| 4,272,812 | 6/1981 | Svensson | 364/474.02 |
| 4,481,533 | 11/1984 | Alzmann et al. | 364/474.02 |
| 4,489,578 | 12/1984 | Nagai et al. | 72/21 |
| 4,916,990 | 4/1990 | Dolansky et al. | 364/474.2 |
| 4,947,719 | 8/1990 | Whistler | 83/140 |
| 4,987,528 | 1/1991 | O'Brien | 364/476 |
| 4,993,295 | 2/1991 | Daley, Jr. | 83/140 |
| 4,998,958 | 3/1991 | Chun et al. | 83/140 |

FOREIGN PATENT DOCUMENTS 2186394 8/1987 United Kingdom .

*Primary Examiner*—Jerry Smith
*Assistant Examiner*—Jim Trammell
*Attorney, Agent, or Firm*—Edmund M. Jaskiewicz

[57] ABSTRACT

A punching machine has a punch holder driven under the influence of a first control device and a second control device for adjusting a die holder in height relative to a supporting face for sheet type material to be worked. There are measuring devices producing a first data signal representing the height of the die to be used, a second data signal representing the height of the punch to be used and a third data signal representing the thickness of the material to be worked. A data processing device receives the three data signals and in response thereto produces a first control signal fed to the first control device for controlling the punch holder in such a way that at the end of its operating stroke the end of the punch lies at a predetermined distance below the top surface of the material to be worked, and produces a second cotnrol signal fed to the second control device for taking the top surface of the die into a predetermined height setting relative to the supporting face prior to the operating stroke of the punch.

9 Claims, 7 Drawing Sheets

PUNCHING MACHINE WITH CONTROLLED PUNCH AND DIE POSITIONING AND CONTROLLED PUNCH OPERATING STROKE

BACKGROUND OF THE INVENTION

This invention relates to a punching machine, comprising a die holder for an exchangeable die, a supporting face for sheet-type material to be worked, and a punch holder, for an exchangeable punch interacting with the die, the punch holder to be driven at right angles thereto under the influence of a first control device.

DISCUSSION OF THE PRIOR ART

Such punching machines are generally known and are used for making shaped holes, slits and the like in sheet-type material. In addition, it is possible with these machines, depending on the shape of a punch and a die, to provide the material to be worked with protuberances, possibly combined with holes.

The punching of various holes and/or protuberances requires different punches with matching dies and strippers. In practice, these elements will thus have to be changed many times. When this changing has to take place quickly (something which is necessary to reach high production) these three different elements are accommodated together in a standard tool holder. Such a tool holder, containing a punch, a die and a stripper, is simple to fit in and remove from the punching machine. This solution does, however, require the use of several expensive tool holders, which tends to increase costs and is thus unattractive, in particular for small and medium-sized businesses, where relatively small series are manufactured. Besides, the tools must be purpose-made for the tool holder in question.

During use of the punching machine the tool is subject to wear due to the great forces acting on it, and in particular the cutting edges of the moving punch and the stationary die will become less sharp. Given the high price of the tools, the above are therefore ground after some time, which makes the above-mentioned cutting edges sharp enough again for accurate and problem-free punching. The grinding of the punching tools is possible a number of times depending on the wear, to prolong their service life, and the height of the punch or die decreases each time.

The height of the die lost through the grinding is compensated for by fitting filler plates between the die holder and the die. The punch height reduced by the grinding can also be compensated for in this way. The fitting of filler plates, which is also necessary when punch and die are fitted in a separate tool holder, is a laborious operation.

The punch is driven over a fixed operating stroke length, and this length is great enough to allow a punching to be carried out in a material to be worked with a specific, maximum thickness. Where the material is of lower thickness the use of the great fixed operating stroke length results in loss of energy and time.

Another disadvantage of the punching machines according to the state of the art is that the stripper pressure on the material to be worked is difficult to adjust and increases during the punching as a result of the fact that the punch movement and the stripper movement are coupled by means of a spring element. This is a particular disadvantage when punching soft materials, when an impression of the stripper can be left behind in the material, which is undesirable.

In addition, the production of a known stripper, intended for interacting with a punch of an angular shape and intended for guiding the latter, is expensive as a result of the necessary processing operation (spark erosion).

SUMMARY OF THE INVENTION

The object of the invention is to diminish the above-mentioned disadvantages.

This object is attained according to the invention by a punching machine, comprising:

- a second control device for adjusting the die holder in height relative to the supporting face;
- a first measuring device for producing a first data signal representing the height of the die to be used;
- a second measuring device for producing a second data signal representing the height of the punch to be used;
- a device for producing a third data signal representing the thickness of the material to be worked;
- a data processing device to which the three data signals are fed and which in response thereto:
- produces a first control signal to be fed to a first control device for controlling the punch holder in such a way that at the end of the operating stroke thereof the end of the punch lies at a predetermined distance below the top surface of the material to be worked, and
- produces a second control signal to be fed to the second control device for taking the top surface of the die into a predetermined height setting relative to the supporting face prior to the operating stroke of the punch.

In the punching machine according to the invention there is no separate tool holder, and use can be made of standard tools which are obtainable cheaply in many places, and which can be fitted quickly in the appropriate holders using a drawer system which will not be described in any further detail.

Controlling the operating stroke of the punch holder depending on the length of the punch produces a saving in the time and energy required for a punching operation. The same beneficial effect occurs if the initial position of the punch holder is adapted to the actual thickness of the material to be worked, which initial position then lies, for example, at a fixed distance from the top surface of the material to be worked.

Furthermore, after the grinding of the punch, the use of filler plates in the punching machine according to the invention is unnecessary, since the movement of the punch holder is controlled depending on the actual punch height determined by a measuring device. Nor do filler plates have to be used any longer after grinding of the die, since the die is moved into a predetermined height setting relative to the supporting face depending on the actual die height determined by a measuring device.

In the punching machine according to the invention the stripper pressure on the sheet material can be set and limited independently of the movement of the punch during contact of the stripper with the material, as a result of which the stripper need no longer damage the material to be worked.

The arrangement of the punch and the stripper is such that the stripper going with the punch can be made with the aid of the punch itself from a "blind" stripper.

This constitutes a considerable cost saving, in particular in the case of complex punch shapes.

The claims and advantages will be more readily appreciated as the same becomes better understood by reference to the following detailed description and considered in connection with the accompanying drawings in which like reference symbols designate like parts in the figures.

DESCRIPTION OF THE PREFERRED EMBODIMENTS

Figure 1:
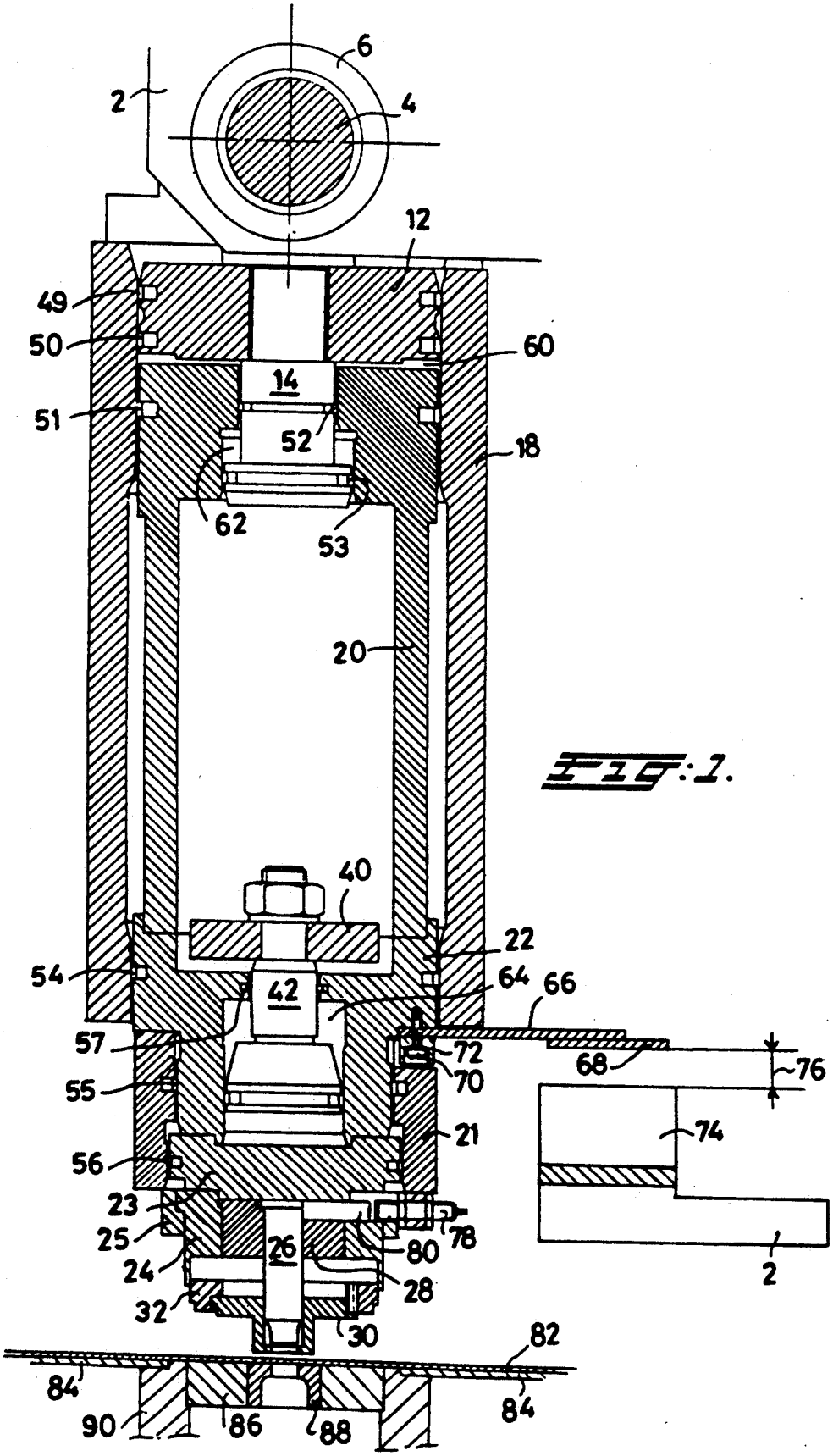
FIG. 1 is a side view in cross-section of a part of the punching machine according to the invention.
Figure 2:
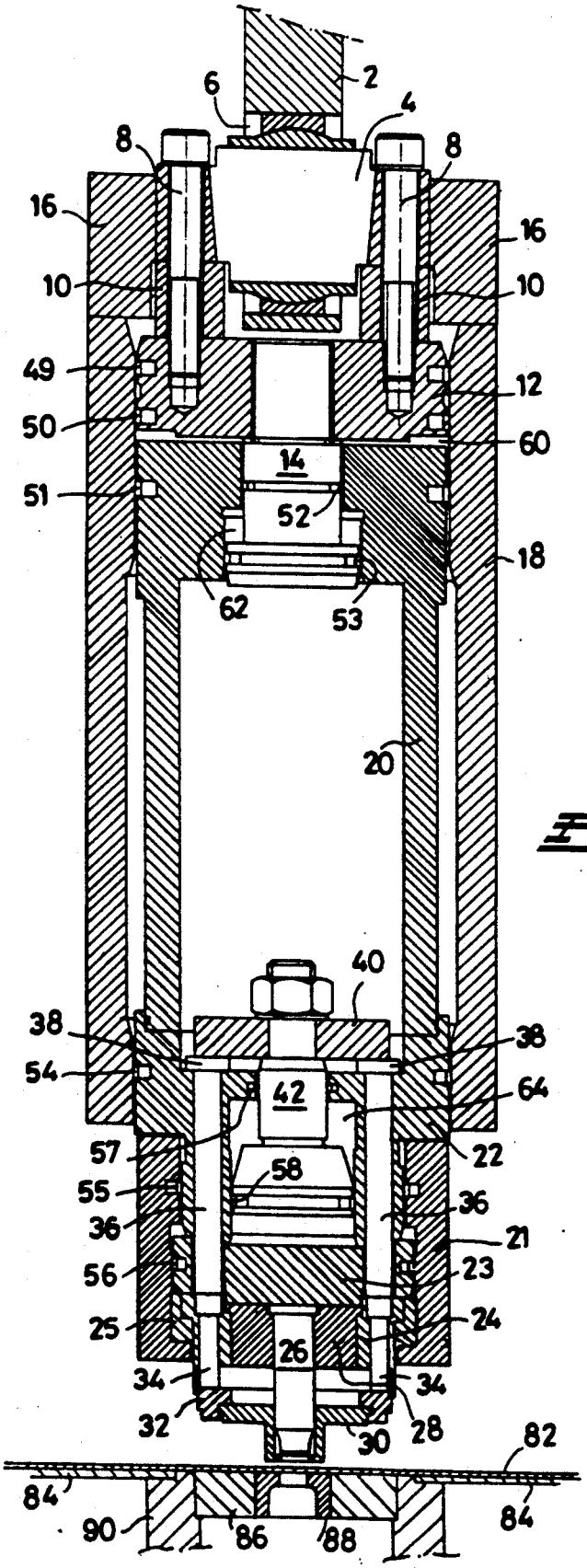
FIG. 2 is a front view in cross-section of the part of the punching machine of FIG. 1.

FIGS. 1 and 2 show a part of a frame 2, in which a shaft 4 is fixed rotatably by means of a bearing 6. The shaft 4 is rigidly connected by means of bolts 8 and coupling sleeves 10 to a reaction piston 12, in which a fixing connection 14 is screwed down. The shaft 4 is also guided in fixing collar 16, which is coupled to a cylinder 18. Slidably fitted in the cylinder 18 is a working cylinder 20, which is firmly connected by means of bolts (not shown) to elements 22 and 23.

Below element 23 is a punch 26 which via a punch holder 28, holder 24 and slide 25 is hydraulically positioned by means of ring 21 and is wedged against element 23. Around the end of the punch 26 is a stripper 30 accommodated in a stripper holder 32, which is coupled to pins consisting of two parts 34 and 36. The pin parts 36 each have at their end a stop part 38, on which rests a ring 40 which is fixed to a piston 42 by means of a screwed connection.

The device described above is driven hydraulically and, in order to prevent leakage of hydraulic fluid, is 51, 52, 53, 54, 55, 56, 57 and 58 fitted in grooves.

If spaces 60 and 62 are filled with hydraulic fluid, the working cylinder 20 can be shifted relative to the cylinder 18 and the fixing connection 14, by pressing fluid under pressure into the space 60 and at the same time allowing fluid to flow out of the space 62, or vice versa. The movement of the working cylinder 20 is in this case limited, on the one hand, by the reaction piston 12 and, on the other hand, by a thickened portion at the end of the fixing connection 14.

In addition, there is hydraulic fluid under pressure in a space 64, so that the piston 42 is pressed to the position shown in the drawing and the ring 40 connected thereto presses the pin parts 36 until the stop part 38 rests on the element 22. This causes the pin parts 34 to be pressed with their stop parts into the holder 24.

An arm 66 is secured on the element 22 by means of a screw 70 and a pressure sleeve 72. Fitted on the arm 66 is a plate 68, which interacts with a transducer 74, which is fitted on a part of the frame 2 and emits a data signal which is a measure of the distance 76 between the plate 68 and the transducer 74, and thus constitutes a measure of the position of the working cylinder 20 relative to the cylinder 18, i.e. the position of the punch 26 relative to the frame 2.

Further a proximity sensor 78 is provided, which can detect the presence of a projecting part 80 of the punch holder 28. Thus, a monitoring of the correct position of the punch 26 or the punch holder 28 is possible.

Below the stripper 30 the sheet-type material 82 to be worked lies on a supporting face 84. The top surface of a part of a die holder 86 with a die 88 lies flush with the top surface of the supporting face 84.

Figure 3:
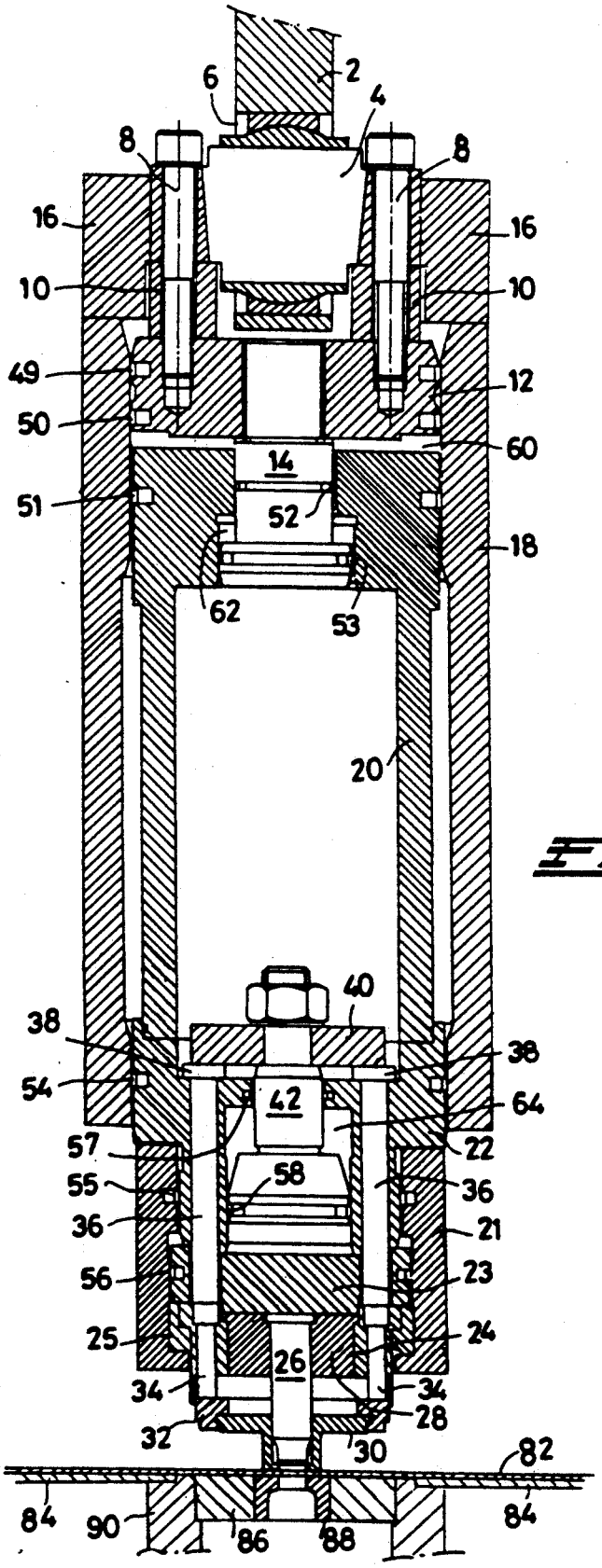
FIGS. 3 and 4 are views in cross-section of the part of the punching machine of FIG. 2, in other working positions.
Figure 4:
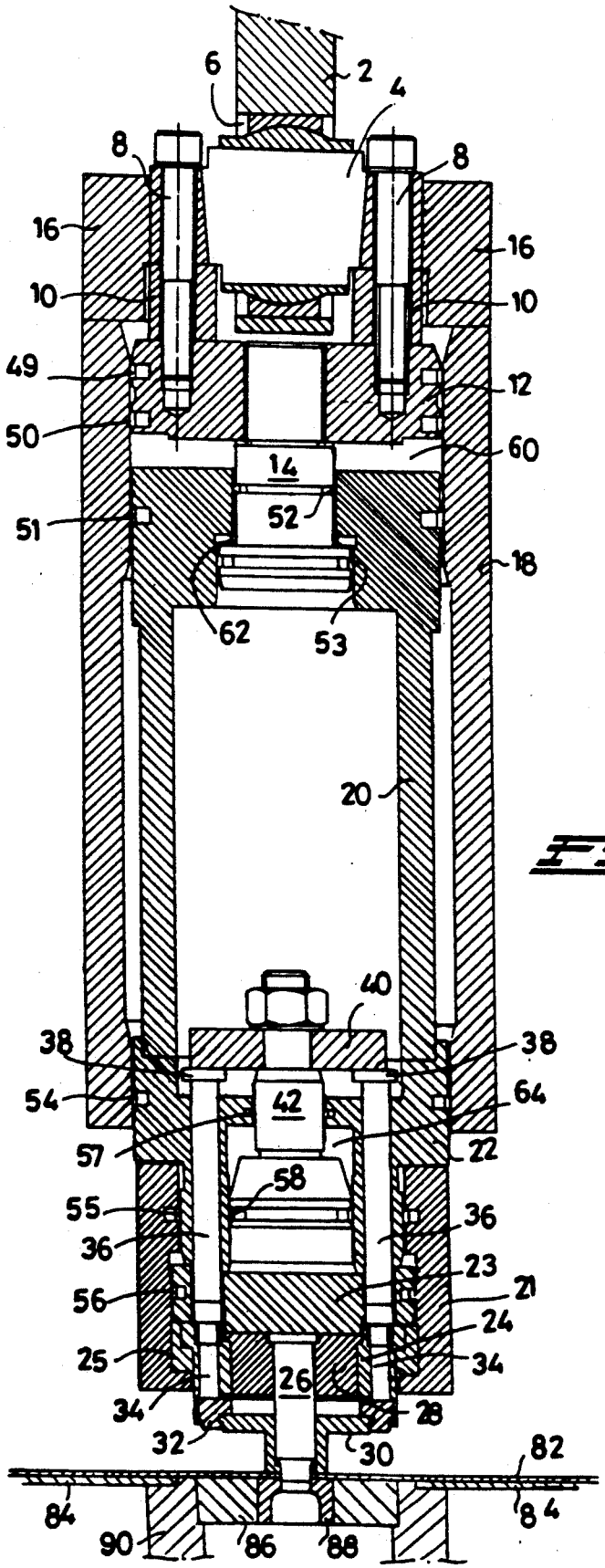

The way in which a punching operation is carried out with a punching machine according to the invention is described below with reference to FIGS. 3 and 4.

From the initial position shown in FIGS. 1 and 2, working cylinder 20 is moved downwards inside cylinder 18 by pressing hydraulic fluid under pressure into the space 60 and simultaneously making hydraulic fluid flow away out of the space 62. The punch 26 and the stripper 30 thereby move together towards the material 82 to be worked, just until the stripper 30 rests on the top surface of the material. FIG. 3 shows this position.

If the working cylinder 20 is driven down still further, then the punch 26 moves further through the hole in the stripper 30 and through the material 82, while the stripper 30 remains resting on the material. The stripper holder 32 here presses the pin parts 34 up in holder 24, and these pin parts 34 press the pin parts 36 up in elements 22 and 23. The pin parts 36 thereby press the ring 40 with the piston 42 fixed thereon up relative to element 22, as a result of which hydraulic fluid is pressed out of the space 64. This is possible through the fact that the space 64 is connected to a hydraulic buffer (not shown in further detail), in which the pressure is adjustable and virtually constant, for example a space in which a small volume of fluid is maintained under adjustable pressure by means of a large volume of gas. During the punching operation, stripper 30 is thus pressed with a constant, adjustable force onto the material to be worked.

It can be seen from FIGS. 1 and 2 that the end of the punch 26 in the initial position of the punching machine lies above the hole in the stripper 30, and that during a punching operation (see FIGS. 3 and 4) the end of the punch moves through the hole in the stripper. If the stripper 30 is not provided with a hole (in which case the stripper is "blind"), at the next punching operation a hole precisely adapted to the shape of the punch will be produced in the stripper, which means that an expensive working of the individual stripper to obtain a shaped hole is not necessary.

The transducer 74 described with reference to FIGS. 1 and 2 emits a data signal containing information on the position of the drive of the punch. With such information a control of the initial position and of the operating stroke of the punch is possible in principle. Since, however, the punch height is variable as a result of grinding, and it plays a role in this control, as will be explained below with reference to FIG. 7, the control must be provided with the actual height measurement of the punch 26. The drive of the die is also controllable in a similar way for the positioning thereof, as will be made clear below with reference to FIG. 6. This control must in this case also be provided with the actual height measurement of the die, which measurement is variable as a result of grinding.

Figure 5A:
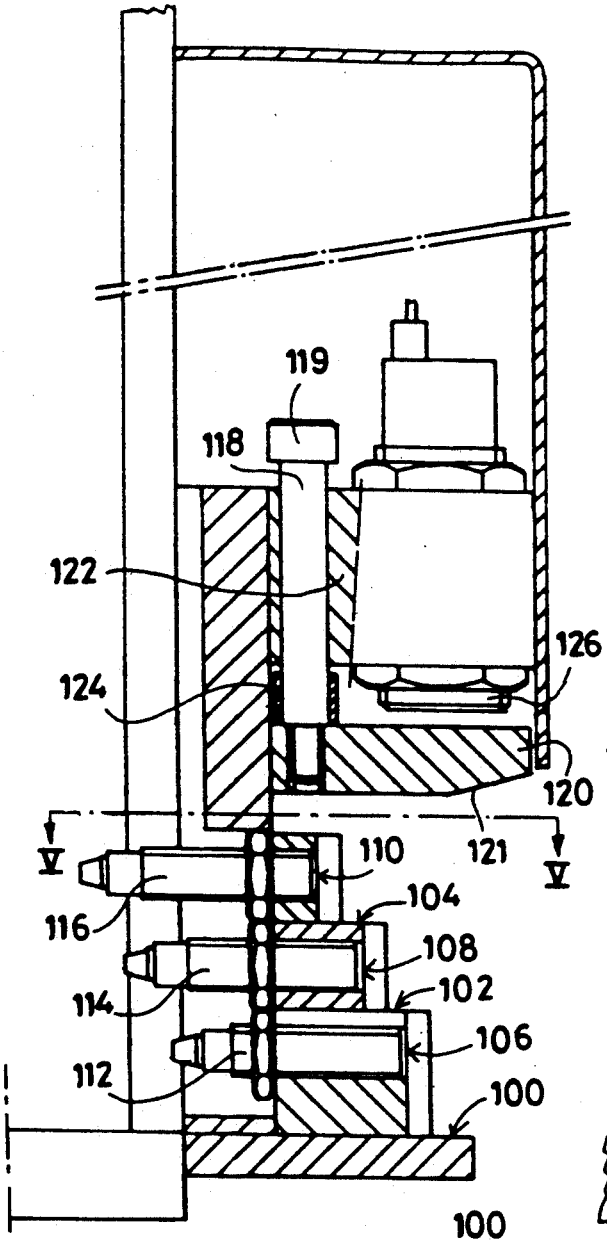
FIG. 5*a* is a side view in cross-section of a measuring device according to the invention.
Figure 5B:
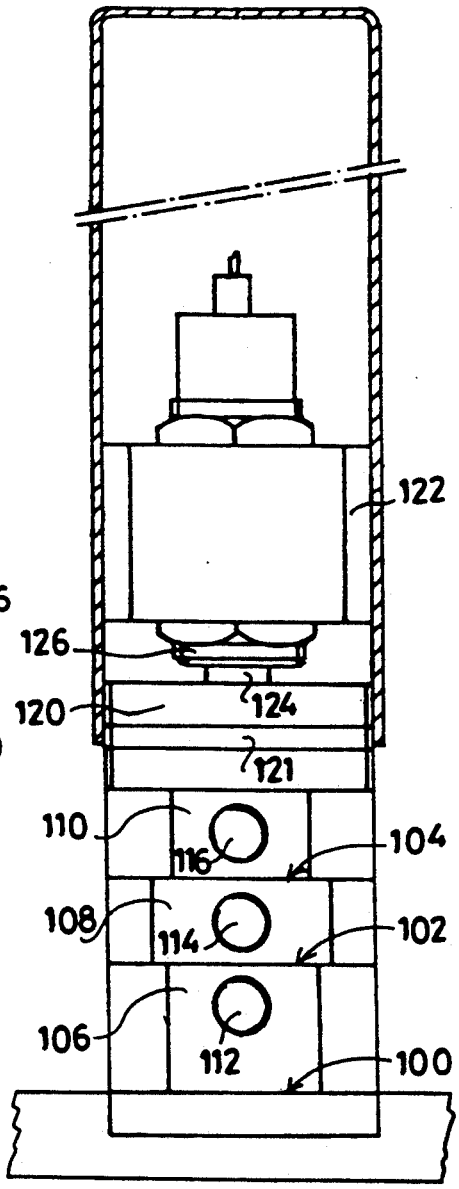
FIG. 5*b* is a front view of the measuring device of FIG. 5*a*, partially cut away.
Figure 5C:
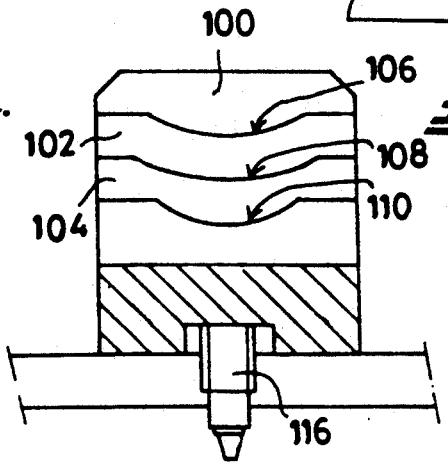
FIG. 5*c* is a top view of the measuring device of FIG. 5*a* in cross-section along line V—V.

A measuring device, shown in FIGS. 5*a*, 5*b* and 5*c* serves for measuring the height of the punch and the die. The measuring device comprises a step-shaped bottom part with steps 100, 102 and 104 each connecting to upright, curved faces 106, 108 and 110 respectively, and behind each of which a proximity sensor 112, 114 and 116 respectively is fitted. Fitted above and parallel to all steps 100, 102 and 104 is a measuring plate 120 which is slidable by means of a pin 118 at right angles to the steps and is provided with a bevel 121. The pin 118 can slide downwards in a block 122 until a thickened stop end 119 further prevents this, and can slide upwards until a sleeve 124 further prevents this. Fitted above the measuring plate 120 is a transducer 126 which can emit a data signal which constitutes a measure of the distance between the top side of the measuring plate 120 and the bottom end of the transducer 126.

The distance between the bottom side of the measuring plate 120 and the bottom step 100 is known for the initial position of the measuring device, where the stop end 119 rests on block 122, and is slightly smaller than the minimum height of a punch. In the same position of the measuring device the distance between the bottom side of the measuring plate 120 and the other steps 102 and 104 is also known and is slightly smaller than the minimum height of a first and a second type of die.

For measurement of the height of a punch, it is placed on step 100, against face 106. With proximity sensor 112 the presence of the punch is simple to establish, so that the kind of element (punch or die) of which the height is being measured is known. For the placing of the punch the measuring plate 120 is pressed upwards over a specific distance, from which distance, together with the known thickness of the measuring plate 120 and the known distance from the bottom side of the measuring plate 120 to the step 100, the actual height of the punch can be derived and recorded simply by electronic means.

In a corresponding way the height of a die can be determined and recorded on step 102 or 104, while with respective proximity sensor 114 and 116 it is possible to establish that the measurement relates to a die height.

Figure 6:
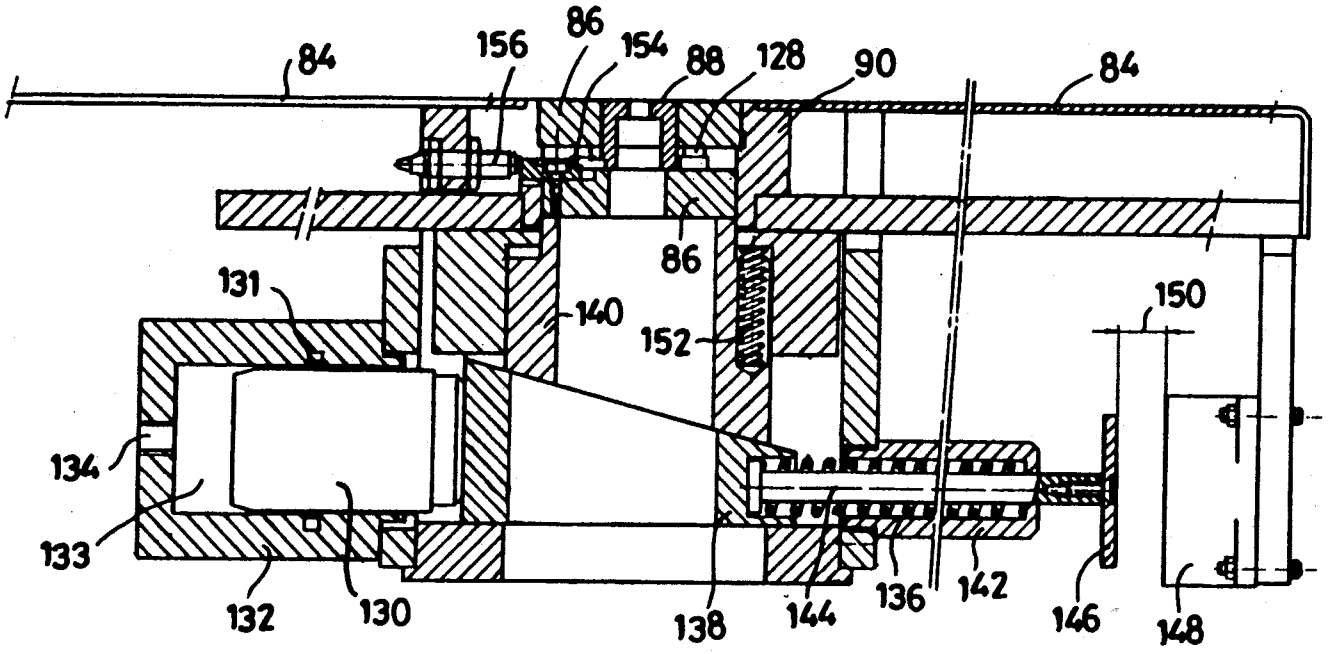
FIG. 6 is a side view in cross-section of a die in a controllable die holder.

FIG. 6 shows the die 88 in the die holder 86, comprising a bottom part and a top part. The bottom part is provided with various pins 128, only one of which is shown, and which during an upward movement of the bottom part can slide in a guide 90 up to a stop edge in the top part. The bottom part of the die holder 86 thereby makes the die 88 slide through the top part.

An upward or downward movement of the die 88 is indirectly caused by a movement to the right or to the left of a piston 130 in a cylinder 132 provided with a seal 131, which piston movements are produced, on the one hand, by admitting hydraulic fluid under pressure through an opening 134 into a space 133 in the cylinder 132 and, on the other hand, making this fluid flow out of the space 133 under the influence of the force of a spring 136 on a first wedge-shaped element 138 driven by the piston 130. The horizontal movement of the first wedge-shaped element 138 over a certain distance produces a vertical movement of a second wedge-shaped element 140 over a smaller distance, as a result of which the bottom part of the die holder 86 and the die 88 are also moved in the vertical direction.

Spring 136 is situated in a holder 142, in which a pin 144 is also fitted, one end of which pin is always coupled by means of the spring 136 to the wedge-shaped element 138, and of which the other end is provided with a plate 146 by means of a screw connection.

The plate 146 interacts with a transducer 148 which can produce a data signal constituting a measurement of the distance 150 between the plate 146 and the transducer 148.

Through the control of the inflow and outflow of hydraulic fluid inside the cylinder 132, depending on the determined distance 150, the top side of the die can be positioned relative to the supporting face 84. Compression spring 152 here ensures a constant contact between the wedge-shaped parts 138 and 140.

Screwed onto the bottom part of the die holder 86 is a projecting part 154, coupled with the die 88. When the die 88 is in a correct position in the die holder, the projecting part 154 faces a proximity sensor 156, as a result of which a detection of this correct position or a deviation therefrom is possible.

Other not designated hatched parts in FIG. 6 are structural parts which take up a fixed position relative to the supporting face 84.

Figure 7:
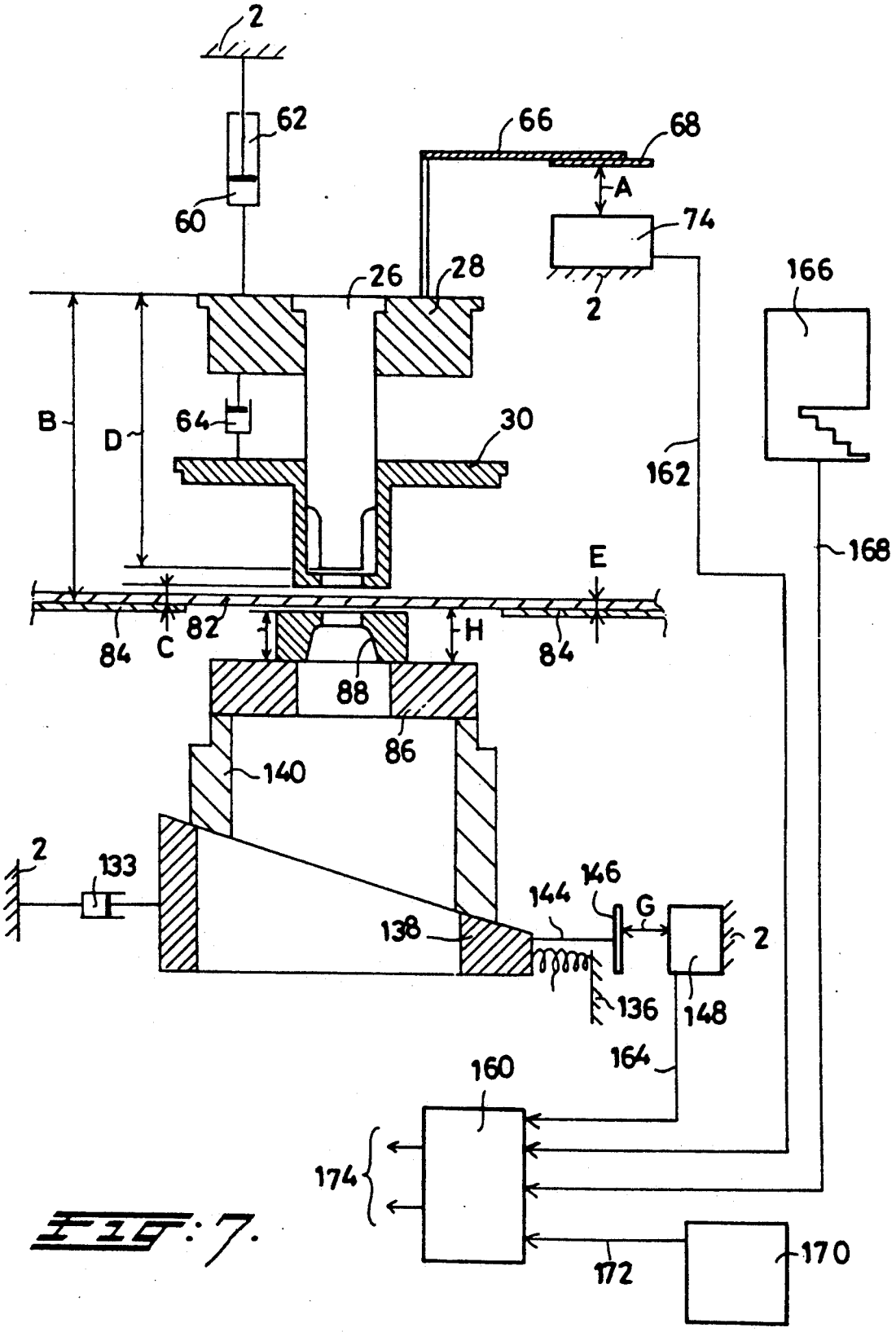
FIG. 7 is a schematic illustration to explain how the punching machine according to the invention works.

FIG. 7 shows elements necessary for a punching operation, the hydraulic drives being shown only symbolically as a piston in a cylinder. At various points the frame 2 is also shown symbolically as a fixed fastening point for the elements.

Distance A between plate 68 and transducer 74 varies, as do distance B between the top side of the punch 26 and the top side of the supporting face 84, and distance C between the bottom side of the stripper 30 and the supporting face 84. At least one combination of the distances A, B and C is known and stored in a memory of the data processing unit of the punching machine. Distance D is the actual punch height which can vary through grinding. Distance E is the thickness of the material to be worked. Distance G is the distance between plate 146 and transducer 148 and is variable. Distance H between the top side of the supporting face 84 and the top side of the die holder 86 is in a fixed, known relationship to distance G. At least one combination of the distances G and H is known and stored in a memory of the data processing unit of the punching machine. Distance K is the actual height of the die 88, which height can vary as a result of grinding.

FIG. 7 shows a data processing unit 160, with which incoming data signals from transducer 74 via line 162, from transducer 148 via line 164, from measuring device 166 according to FIGS. 5*a*, 5*b* and 5*c* via line 168 and from a device 170 for the input of the thickness E of the material to be worked via line 172 are processed and by means of a control program lead to control signals 174 for the hydraulic drives in the punching machine.

Prior to the punching the top side of the die 88 is positioned at the same height as the top side of the supporting face 84. The data processing unit 160 regulates distance G for this purpose in such a way that the distance H proportionate thereto corresponds to the die height K measured with the device 166. Also prior to punching, the stripper 30 is placed at a predetermined distance, for example 0.5 mm, above the material to be worked. The data processing unit 160 controls the distance A for this purpose in such a way that the difference distance C–E is equal to 0.5 mm.

During the punching the punch 26 is moved through the material 82 until the end of the punch 26 lies a predetermined distance below the top side of the material. This distance can be, for example, equal to the thickness of the material, plus 0.5 mm. Making use of the distance D which has become known during the measurement of the punch height with the device 166, the data processing unit 160 then regulates the distance A in such a way that at the end of the punching stroke the difference distance B-D is equal to −0.5 mm.

A different embodiment from the embodiment of a punching machine according to the invention described above may contain a magazine for different punches and dies, each magazine place for a punch or a die being provided with a measuring device for determining the height thereof, for example of the type described with reference to FIGS. 5*a*, 5*b* and 5*c*.

Each magazine place is then designed in such a way that, after a punch or a die is put away in it, while it is being placed in it or prior to its removal from it, the height measurement of the particular tool is carried out, following which this height information is stored in the memory of the relevant control program. When this control program is being run the control signals for the hydraulic drives determining the position of punch and die are then passed on automatically per tool place before the punch movement is carried out, all this in the manner described above with reference to FIG. 7.

The putting away of a punch or a die in a magazine place or its removal therefrom can be established by means of a proximity sensor such as the sensors 112, 114 or 116 in FIGS. 5*a* and 5*b*.

The placing of the tools in the holders of the punching machine can take place by hand here, but can also be by means of a controlled mechanical device which permits an automatic tool change.

What is claimed is:

1. A punching machine, comprising a for an exchangeable die, a supporting face for sheet-type material to be worked, and a punch holder, for an exchangeable punch interacting with the die, the punch holder to be driven at right angles to said supporting face under the influence of a first control device, further comprising:

a second control device for adjusting the die holder in height relative to the supporting face;

a first measuring device for producing a first data signal representing the height of the die to be used;

a second measuring device for producing a second data signal representing the height of the punch to be used;

a device for producing a third data signal representing the thickness of the material to be worked;

a data processing device to which the three data signals are fed and comprising first means for producing a first control signal in response to said data signals to be fed to said first control device for controlling the punch holder such that at the end of the operating stroke thereof the end of the punch lines at a predetermined distance below the top surface of the material to be worked, and second means for producing a second control signal in response to said data signals to be fed to the second control device for taking the top surface of the die into a predetermined height setting relative to the supporting face prior to the operating stroke of the punch.

2. A punching machine according to claim 1, wherein the first control device takes the punch holder into a predetermined initial position relative to the supporting face, which position is independent of the actual punch height, and controls the length of the operating stroke of the punch holder depending on the actual punch height.

3. A punching machine according to claim 1, wherein the first control device takes the punch holder into a predetermined initial position relative to the top surface of the material to be worked, which position is independent of the actual punch height, and controls the length of the operating stroke of the punch holder depending on the actual punch height.

4. A punching machine according to claim 1, wherein the first and second measuring devices comprise respective steps of a step-shaped element and a measuring face which is movable above and at right angles to the steps and is coupled to a displacement sensor.

5. A punching machine according to claim 4, wherein the distance from a first step to the measuring face is slightly smaller than the minimum die height, and the distance from a second step to the measuring face is slightly smaller than the minimum punch height.

6. A punching machine according to claim 4, comprising proximity sensors disposed in upright faces connecting to each of said steps.

7. A punching machine according to claim 4, comprising a magazine for dies and punches having at least one magazine place, each magazine place comprising a first and second measuring device respectively.

8. A punching machine according to claim 7, wherein after the die or punch is put away in a said magazine place the data signal representing the height of the die or punch to be used is fed to the data processing device for generating the control signals for the control devices of the punch holder and the die when the relevant tool is being used.

9. A punching machine according to claim 1, with a punch holder which is driven by a double-acting hydraulic cylinder/piston unit, and a tripper which is connected to the punch holder by means of a spring element, wherein the spring force of the spring element cannot exceed a certain settable value irrespective of the spring travel, said spring element comprises a single-acting hydraulic operating element which is driven by a fluid under adjustable pressure in a buffer, in such a way that in the initial position of the punch holder and during movement of the stripper above the material to be worked the stripper is at the end of its operating stroke, and in that during the operating stroke of the punch holder, on contact of the stripper with the material to be worked, the stripper presses the liquid out of the operating element into the buffer.

* * * * *